United States Patent [19]

Ruyter et al.

[11] Patent Number: 4,670,613

[45] Date of Patent: Jun. 2, 1987

[54] PROCESS FOR PRODUCING HYDROCARBON-CONTAINING LIQUIDS FROM BIOMASS

[75] Inventors: Herman P. Ruyter, Amsterdam; Johannes H. J. Annee, The Hague, both of Netherlands

[73] Assignee: Shell Oil Company, Houston, Tex.

[21] Appl. No.: 859,662

[22] Filed: May 5, 1986

[30] Foreign Application Priority Data

May 8, 1985 [GB] United Kingdom ..... 8511587

[51] Int. Cl.[4] ..... C07C 1/00

[52] U.S. Cl. ..... 585/240

[58] Field of Search ..... 585/240

[56] References Cited

U.S. PATENT DOCUMENTS 3,298,928 1/1967 Esterer ..... 201/6

4,271,326 6/1981 Meqo ..... 585/240

OTHER PUBLICATIONS

*C&EN*, Oct. 1, 1979 pp. 34–36.

*Primary Examiner*—Curtis R. Davis

[57] ABSTRACT

Process for producing hydrocarbon-containing liquids from biomass which comprises introducing biomass in the presence of water at a pressure higher than the partial vapor pressure of water at the prevailing temperature into a reaction zone at a temperature of at least 300° C. and keeping the biomass in the reaction zone for more than 30 seconds, separating solids from fluid leaving the reaction zone while maintaining the remaining fluid in a single phase, and subsequently separating liquids from the remaining fluid.

13 Claims, 1 Drawing Figure

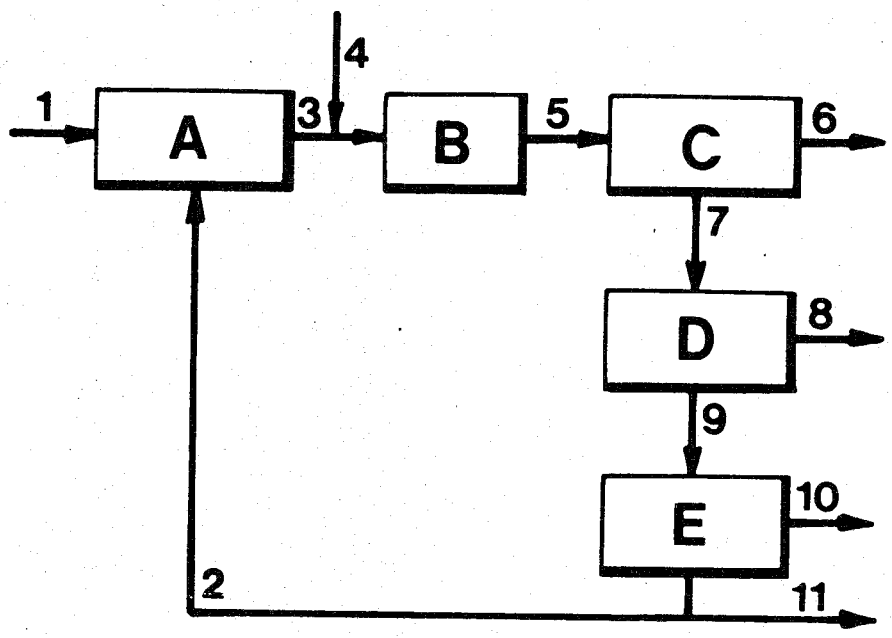
1
A
3
4
B
5
C
6
7
D
8
9
E
10
2
11

PROCESS FOR PRODUCING HYDROCARBON-CONTAINING LIQUIDS FROM BIOMASS

This invention relates to a process for producing hydrocarbon-containing liquids from biomass and to hydrocarbon-containing liquids thus produced.

An increased demand for liquid fuels and (petrochemical) feedstocks produced from locally available resources, in particular in developing countries with low oil- or gas reserves, has led to the development of processes by means of which biomass of various origins can be converted into liquid-gaseous- and/or solid products. Biomass usually comprises up to 50%, even up to 60%, by weight of oxygen, in addition to carbon and hydrogen. Other elements such as sulphur, nitrogen and/or phosphorus may also be present in biomass depending on its origin. It would be advantageous to reduce such biomass with a high oxygen content (i.e. the oxygen/carbon ratio should be substantially reduced) in order to produce attractive products.

In some processes hydrocarbon-containing liquids can be obtained without hydrogen addition, which is desirable since hydrogen is quite expensive to produce and requires sophisticated equipment. For example it is known from U.S. Pat. No. 3,298,928 to convert a feedstock comprising lignocellulose, especially wood, to useful degradation products by means of a pyrolysis process in which lignocellulose particles and entraining gas, which may be nitrogen, carbon dioxide, steam or product gas from the process, are passed through a pyrolysis zone at high temperatures of 600° to 1500° F., preferably 700° to 1100° F. (i.e. 315° to 815° C., preferably 371° to 593° C.) at a high velocity, so that the particles are at this high temperature for not more than 30 seconds, preferably not more than 10 seconds, in order to minimise production of carbon monoxide and other undesirable end products. One disadvantage of such a process is that high gas velocities are required in such a process. Another, major, disadvantage is that the oxygen content of the pyrolysis products will still be substantial.

It has now been found that oxygen may be removed without having to add hydrogen, and a high yield of desired hydrocarbon-containing liquids may be obtained by introducing biomass feed into a reaction zone at a temperature in the reaction zone of at least 300° C. in the presence of water at a pressure which is higher than the partial vapour pressure of water at the prevailing temperature and keeping the biomass in the reaction zone for more than 30 seconds. Surprisingly, oxygen is thereby removed rapidly and very selectively in the form of carbon dioxide, at a moderate reaction temperature. Moreover, it has been found that solids can be separated from fluid leaving the reaction zone while maintaining the remaining fluid in a single phase, which makes solids separation considerably more efficient in comparison with solids separation from a three-phase (gas-liquid-solid) system.

The present invention therefore relates to a process for producing hydrocarbon-containing liquids from biomass which comprises introducing biomass in the presence of water at a pressure higher than the partial vapour pressure of water at the prevailing temperature into a reaction zone at a temperature of at least 300° C. and keeping the biomass in the reaction zone for more than 30 seconds, separating solids from fluid leaving the reaction zone while maintaining remaining fluid in a single phase, and subsequently separating liquids from the remaining fluid.

The process is preferably carried out at a temperature in the reaction zone of from 300° C., preferably 320° C., to 380° C., more preferably from 330° C. to 370° C.; a temperature substantially higher than 380° C. would tend to lead to increased formation of undesirable gaseous by-products, thus wasting valuable hydrocarbons, while at a temperature much lower than 320° C., more particularly one lower than 300° C., decarboxylation, and consequently oxygen removal, of the biomass feedstock would be unacceptably slow. A residence time of the biomass in the reaction zone is preferably less than 30 minutes in order to avoid undesirable charring. The biomass is preferably maintained in the reaction zone for an average reaction period of from 1 to 30 minutes, more preferably from 3–10 minutes. The total pressure to which the biomass is subjected in the reaction zone is conveniently in the range $90\times10^5$ to $300\times10^5$ Pa, preferably $150\times10^5$ to $250\times10^5$ Pa.

The weight ratio of water to biomass in the reaction zone may conveniently be in the range 1:1 to 20:1, and is preferably in the range 3:1 to 10:1.

In preferred processes according to the invention it has been found that lesser amounts of unsaturated (and unstable) products appear to be formed and less polymerization and cross-linking of decarboxylated product appears to take place, compared with the known pyrolysis processes. The formation of relatively stable liquid products with a moderate viscosity, as provided for by the process according to the present invention, is very attractive because such products can be easily stored or transported. Furthermore less hydrogen is needed, if these products are to be subjected to a catalytic hydrogenation treatment, in comparison with the highly unsaturated products of prior art processes, hydrogenation of which would furthermore result in rapid catalyst deactivation due to the formation of polymeric residues.

The process according to the present invention is advantageously carried out under moderately acidic conditions i.e. the pH in the reaction zone is maintained below 7, preferably in the range 2 to 5. Due to the formation of acidic by-products it is in most cases not necessary to introduce additional acidic compounds in the reaction zones. It is only when a strongly alkaline feed is to be processed that a certain degree of neutralisation before or after introducing the feed in the first reaction zone, may be desirable.

A wide variety of biomasses from different origins may be used as feed for the process according to the present invention, e.g. comminuted trees (hard wood as well as soft wood), leaves, plants, grasses, chopped straw, bagasse and other (agricultural) waste materials, manure, municipal waste, peat and/or brown coal. A preferred biomass feed comprises lignocellulose, especially in the form of wood chips or sawdust.

Particulate biomass may conveniently be passed in concurrent flow with fluid through the reaction zone, preferably under substantially plug-flow conditions. Biomass particulates preferably having a sieve size of at most 50 mm, more preferably not exceeding 5 mm (advantageously 3 mm), are suitably slurried with water or recycled aqueous liquid before entering the reaction zone; the particle size should be small enough to avoid heat transfer limitation within the particles, especially since the use of a continuous reactor, which may comprise a single reaction zone or a plurality of reaction zones, is favoured for the process according to the present invention.

In some cases in accordance with the invention it may be preferable to separate fluid comprising desired products from solids and fluid leaving each of a plurality of reaction zones (which may all be contained in one or more continuous reactors) and to transfer residual solids and fluid to another reaction zone or to a separation zone. Such a staged removal of fluid from reaction zones is preferred in cases where some desired products are formed during a shorter reaction period than the average residence time of the feedstock in the reaction zones, and when longer reaction times would lead to undesired charring. However, due to the complex nature of the biomass feedstock another part of the desired product may be formed only after a longer reaction period; such products will be present in fluid separated from a stream of solids and fluid leaving a later or final reaction zone.

An important feature of the process according to the present invention is the separation of solids from fluid which is maintained in a single phase, thus enabling efficient separation (with respect to fluid yield and thermal efficiency) in relatively simple two-phase (solid-gas) separators by means of settling, filtration or centrifugal force. Preferably, solids are separated from fluid leaving the reaction zone in at least one cyclone or in a series of cyclones. In a preferred embodiment of the process according to the present invention solids which are separated from fluid leaving the reaction zone (e.g. by means of a cyclone) are subsequently subjected to an extraction treatment, preferably with low-boiling liquids which may themselves be separated from the fluid further downstream, in order to decrease the amount of valuable liquid products remaining in the solids (which are predominantly carbon and mineral particles).

Fluid which has been separated from solids in the above-described manner may conveniently be separated into liquid and gas which may be separated further. Preferably, fluid separation takes place in at least two separation zones, using a lower temperature and pressure in each subsequent zone, which allows for recycling to other sections of the process (e.g. the reaction zone, a biomass slurrying zone and/or an extraction zone) of separated streams at appropriate temperature and pressure levels, thus saving energy which would otherwise be needed for re-heating and/or re-compression of such streams.

Suitably, in one or more of the separation zones, preferably in a second zone, a substantially aqueous liquid is separated from a substantially non-aqueous liquid in which the major part of the desired hydrocarbon-comprising products are contained; unconverted or partly converted constituents of the biomass feed are usually to some extent water-soluble, probably due to their high oxygen-content, and will accordingly be predominantly present in the substantially aqueous liquid.

In order to increase the yield of substantially decarboxylated liquid products provided by the process according to the present invention, such a substantially aqueous liquid which is separated from fluid leaving the reaction zone is preferably recycled in order to be combined with biomass feed to form a mixture which can be regarded as a slurry. Additional advantages of such recycling include increased thermal efficiency (aqueous liquid may be recycled at a temperature of about 300° C. and at elevated pressure, which reduces the energy needed to heat up the biomass feed to the temperature prevailing in the (first) reaction zone), reduced water consumption and waste water discharge, and a significant improvement in flow characteristics of a combined biomass/recycle water slurry. Preferably, the mixture of biomass and substantially aqueous recycle-liquid is maintained at a temperature in the range 100° to 400° C. and a pressure of from $1\times10^5$ to $300\times10^5$ Pa, most preferably at a temperature of from 180° to 250° C. and a pressure of from $20\times10^5$ to $30\times10^5$ Pa for a period of 1 to 100 minutes before the mixture is pumped to the (first) reaction zone.

In some cases lignocellulose-comprising biomass with a relatively low water content (e.g. dried wood or core wood) will be available for use as feed (component) for the process according to the present invention; such biomass is preferably subjected to a pre-treatment at an elevated temperature using an aqueous solution of an alkaline compound (e.g. sodium carbonate, sodium bicarbonate and/or calcium carbonate, which have the advantage of decomposing to carbon dioxide) before any acidic aqueous recycle liquid is combined with the resulting biomass slurry. This pre-treatment may conveniently be effected at a temperature of from 50° to 150° C. (preferably the boiling temperature of the alkaline aqueous solution), a pH of from 8 to 11 and a treating period of from 1 minute, conveniently 0.1 hours to 10 hours, preferably of from 0.5 to 2 hours. A pH of less than 8 would lead to a less pronounced product yield increase which may be attained with the alkaline pre-treatment, whereas a pH substantially above 11 would give rise to undesirable side reactions leading to a loss of desired products and an additional uneconomical neutralization step between this pre-treatment and the conversion of the biomass in the reaction zone.

Although a substantial decarboxylation of the biomass feed will take place when the process according to the present invention is carried out under appropriate conditions for the particular type of feed to be processed, liquid "crude" products will be obtained which generally still contain 5 to 15% or even as much as 20% by weight of oxygen. In order to obtain stable products which meet stringent specifications for use as liquid fuels or (petrochemical) feedstocks, a further refining step, for example hydrotreatment, is usually needed; this further step may be carried out at a different location from the, possibly geographically remote, location where the biomass conversion takes place without the need for a hydrogen source. However, if desired, hydrogen may be introduced into the (or any or each) reaction zone.

In general, a hydrotreatment comprises contacting liquids separated from fluid leaving the reaction zone with hydrogen in the presence of a catalyst. Preferably, the catalyst comprises nickel and/or cobalt and in addition molybdenum and/or tungsten, which metals may be present in the form of sulphides, on alumina as carrier; advantageously, the catalyst may also comprise 1 to 10% by weight of phosphorous and/or fluorine, calculated on basis of total catalyst, for improved selectivity and conversion to hydrogenated liquid products. Suitable hydrotreatment conditions are, for example, temperatures from 350° to 450° C., preferably 380° to 430° C.; partial pressures of hydrogen from $50\times10^5$ to $200\times10^5$ Pa, preferably $100\times10^5$ to $180\times10^5$ Pa and space velocities from 0.1 to 5 kg liquids/kg catalyst/hour, preferably 0.2 to 2 kg liquids/kg catalyst/hour.

The invention will be further understood from the following illustrative Examples, with reference to the accompanying drawing in which the FIGURE is a simplified block diagram of an apparatus for performing a preferred process.

EXAMPLE I

Referring to the FIGURE, stream 1 amounting to 2 kg/hr of fresh eucalyptus wood particles including 50%w moisture of sieve size 3 mm is passed to a feed conditioning unit (A) wherein the particles are mixed with 4 kg/hr of an acidic recycle-water stream 2 at a temperature of 200° C. and a pressure of $20\times10^5$ Pa for 5 minutes. The resulting slurry stream 3 (6 kg/hr) is heated by means of indirect heat exchange and injection of 0.5 kg/hr of superheated steam as stream 4 to a temperature of 350° C. and pumped into a reactor (B) which is operated at a pressure of $165\times10^5$ Pa, just above the partial vapour pressure of water at 350° C., under substantially plug flow conditions with an average residence time of 6 minutes. The resulting mixture of solids and fluid leaving the reactor (B) as stream 5 is passed to a cyclone (C) wherein 0.3 kg/hr of solids (stream 6; mostly carbon which has absorbed part of the higher boiling hydrocarbon-comprising liquids produced in the reactor) is separated from 6.2 kg/hr of fluid (stream 7), under the conditions prevailing in the reactor (i.e. a temperature of 350° C. and a pressure of $165\times10^5$ Pa). The pressure of the fluid stream 7 is only then reduced to $100\times10^5$ Pa in the liquid/gas separation unit (D) operating at a temperature of 290° C. in order to remove an amount of 0.25 kg/hr of gaseous products as stream 8 (mainly carbon dioxide) from an amount of 5.95 kg/hr of hydrocarbon-comprising liquid and water which is passed as stream 9 to a first oil/water separation unit (E) which is operated at the same temperature and pressure as the liquid gas separation unit (D). Recycle-water stream 2 originates from the first oil/water separation unit, as well as a largely non-aqueous stream which is passed to a second oil/water separation unit (not shown in the block diagram) operating at a temperature of 100° C. and a pressure of $56\times10^5$ Pa. The resulting "crude" oil stream 10 obtained after the two above-described water separation steps (E) amounts to 0.3 kg/hr, whereas 1.65 kg/hr of water is discharged from the process as stream 11 or, optionally, purified and reheated to provide superheated steam for stream 4.

For the above-described embodiment of the process according to the invention the yield, expressed as a weight percentage based on dry biomass feed free of mineral matter, of the various products is given in the following Table A:

TABLE A

| Products | Yield, % w |
|---|---|
| liquid (oil) | 30 |
| carbon | 22 |
| gas | 25 |
| water (including water solubles) | 23 |

The composition of the wood used as biomass feed and of the "crude" oil produced in the above-described embodiment of the process is given in the following Table B:

TABLE B

| Element | Weight percentage in: feed | Weight percentage in: liquid product |
|---|---|---|
| C | 48 | 79 |
| H | 6 | 10.5 |
| O | 45.5 | 10 |
| N | 0.5 | 0.5 |

From the results given hereinabove it is clear that a biomass feedstock with a high oxygen content can be substantially decarboxylated in an efficient manner without hydrogen addition by means of the process according to the present invention.

EXAMPLE II

Another process in accordance with the present invention was effected in similar manner to Example 1 except that upstream from the feed conditioning unit (A) a pre-treatment step was carried out in which 1 kg/hr of similar eucalyptus wood particles as used in Example I but having a relatively low water content of 9% by weight (based on dry wood) was treated with 5 kg/hr of an aqueous stream containing 1% by weight of sodium carbonate (calculated on total mass flow of the aqueous stream) at a temperature of 100° C. and atmospheric pressure for 1 hour. The resulting stream was filtered, the filter cake was washed with neutral water and the resulting filter cake was further treated in a similar manner as stream 1 described in Example I.

The yield of the various products, expressed as a weight percentage based on dry biomass feed free of mineral matter, is given in the following Table C:

TABLE C

| Products | Yield, % w |
|---|---|
| oil | 50 |
| carbon | 10 |
| gas | 20 |
| water | 20 |

From a comparison of the oil yields attained in Examples I and II it is clear that the pretreatment under alkaline conditions of a biomass which comprises relatively dry lignocellulose is advantageous.

EXAMPLE III

Oil as obtained in Example I still contains an appreciable amount of oxygen and is as such far from optimal in most cases for use as engine fuel or as (petrochemical) feedstock. The quality of the oil can be considerably improved by a hydrotreatment which is carried out as follows. 7 g/hr of oil was passed in a once-through mode of operation through 11 g (13 ml) of a catalyst containing 2.7%w nickel and 13.2%w molybdenum, calculated on basis of total catalyst, on alumina as carrier and diluted with 13 ml of silicium carbide in a microflow hydrotreating unit. The hydrotreatment was carried out at a temperature of 425° C., a hydrogen partial pressure of $150\times10^5$ Pa and a space velocity of 0.6 kg feed/kg catalyst/hour. The liquid products were collected and the product gas flow and its composition were measured, the latter by GLC (gas-liquid chromatography) analysis.

In the following Table D yields of the various product streams obtainable are given, calculated as parts by weight (pbw) based on 100 pbw of oil feed hydrogenated with 3.5 pbw of hydrogen:

TABLE D

| Products | Yield, % w |
|---|---|
| Liquid boiling in the range: | |
| $C_5$-165° C. | 7.7 |
| 165-250° C. | 18.3 |
| 250-370° C. | 29.1 |
| 370-520° C. | 26.2 |
| >520° C. | 5.6 |
| Gas: $C_1$-$C_4$ compounds | 2.2 |
| $H_2O$ | 10.3 |
| $NH_3$ | 0.6 |

From the results given hereinabove it can be seen that the liquids obtained after hydrotreating comprise a substantial amount of valuable middle distillates, boiling in the range of 165°-370° C., as well as products boiling in the gasoline range ($C_5$-165° C.). It should be noted that the vacuum distillate (boiling above 370° C.) thus obtained has a high paraffin content and may suitably be applied as feed in a process for producing lubricating oils. The formation of gaseous products is relatively low.

The results of the above-described hydrotreatment are further illustrated by means of the following Table E in which the composition of the total liquid product is given:

TABLE E

| Element | Weight percentage in liquid product |
|---|---|
| C | 86.2 |
| H | 13.8 |
| O | <0.01 |
| N | <0.01 |

It clearly follows from the results given in Table E that the hydrotreatment according to an embodiment of the process of the present invention provides excellent liquid products with a low oxygen- and nitrogen content.

COMPARATIVE EXAMPLE IV

An experiment which is outside the scope of the present invention was carried out by a procedure similar manner to that of Example I, except that slurry stream 3 (6 kg/hr) was heated by means of indirect heat exchange and injection of 0.5 kg/hr of superheated steam to a temperature of 290° C. and pumped into reactor (B) at a pressure of $85\times10^5$ Pa. The average residence time of the slurry in reactor B was 15 minutes. From the resulting multi-phase product stream leaving reactor B a hydrocarbon-containing product was separated. The composition of the total (solids and liquids) product is given in the following Table F:

TABLE F

| Element | Weight percentage in total product |
|---|---|
| C | 57.5 |
| H | 6 |
| O | 36 |
| N | 0.5 |

The results given in Table F show that inadequate removal of oxygen occurs at the prevailing conditions in reactor B. The resulting multi-phase product stream could not be separated by means of solid-gas separators.

Moreover, the yield of "crude" oil obtained by extraction of the hydrocarbon-containing product was only 7% by weight, based on dry biomass feed. The composition of the oil is given in Table G:

TABLE G

| Element | Weight percentage in: feed | Weight percentage in: liquid product (oil) |
|---|---|---|
| C | 48 | 61.5 |
| H | 6 | 10 |
| O | 45.5 | 28 |
| N | 0.5 | 0.5 |

From the results given hereinabove it is clear that the "crude" oil obtained in the comparative experiment still has a very high oxygen content (due to insufficient decarboxylation), thus requiring large amounts of hydrogen for subsequent hydrotreatment in order to stabilize the oil.

We claim:

1. A process for producing hydrocarbon-containing liquids which consists essentially of introducing biomass in the presence of water at a pressure higher than the partial vapor pressure of water into a reaction zone(s) at a temperature of at least 300° C. and keeping the biomass in the reaction zone(s) for more than 30 seconds, separating solids from the fluid leaving the reaction zone(s) while maintaining the remaining fluid in a single phase, and subsequently separating liquids from the remaining fluid.

2. The process of claim 1 wherein the temperature in the reaction zone(s) ranges from 320° to 380° C.

3. The process of claim 1 wherein the biomass is maintained in the reaction zone(s) for an average reaction period of from 1 to 30 minutes.

4. The process of claim 1 wherein the total pressure in the reaction zone(s) is in the range of $90\times10^5$ to $300\times10^5$ Pa.

5. The process of claim 1 wherein the weight ratio of water to biomass in the reaction zone(s) is in the range of 1:1 to 20:1.

6. The process of claim 1 wherein the pH in the reaction zone(s) is maintained below 7.

7. The process of claim 1 wherein the biomass comprises lignocellulose.

8. The process of claim 1 wherein particulate biomass passing a sieve opening not exceeding 5 mm is introduced into the reaction zone(s).

9. The process of claim 1 wherein biomass is converted in a plurality of reaction zones.

10. The process of claim 1 wherein a substantially aqueous liquid is separated from the remaining fluid and combined with biomass feed to form a slurry.

11. The process of claim 10 wherein the slurry is maintained at a temperature ranging from 100°-400° C. and a pressure ranging from $1\times10^5$ to $300\times10^5$ Pa for from 1-100 minutes before introducing the slurry into the reaction zone(s).

12. The process of claim 1 wherein the biomass to be passed to the reaction zone(s) is pretreated at a pH of from 8 to 11, at a temperature ranging from 50° to 150° C. for 0.1 to 10 hours.

13. The process of claim 1 wherein liquids separated from the remaining fluid are contacted with hydrogen at hydrotreating conditions in the presence of a catalyst comprising at least one hydrogenating metal on a carrier.

* * * * *